US009861865B1

(12) United States Patent
Harbert et al.

(10) Patent No.: US 9,861,865 B1
(45) Date of Patent: Jan. 9, 2018

(54) HOLLOW GOLF CLUB HEAD WITH STEP-DOWN CROWN AND SHROUD FORMING SECOND CAVITY

(71) Applicant: Taylor Made Golf Company, Inc., Carlsbad, CA (US)

(72) Inventors: Christopher John Harbert, Carlsbad, CA (US); Joseph Reeve Nielson, Vista, CA (US); Robert Nunez, Vista, CA (US); Nathan T. Sargent, Oceanside, CA (US); Christian Reber Wester, San Diego, CA (US)

(73) Assignee: Taylor Made Golf Company, Inc., Carlsbad, CA (US)

( * ) Notice: Subject to any disclaimer, the term of this patent is extended or adjusted under 35 U.S.C. 154(b) by 0 days.

(21) Appl. No.: 14/975,117

(22) Filed: Dec. 18, 2015

Related U.S. Application Data

(60) Provisional application No. 62/096,605, filed on Dec. 24, 2014.

(51) Int. Cl.
*A63B 53/04* (2015.01)

(52) U.S. Cl.
CPC .. *A63B 53/0466* (2013.01); *A63B 2053/0437* (2013.01); *A63B 2053/0491* (2013.01)

(58) Field of Classification Search
CPC ..... A63B 2053/0437; A63B 2060/006
USPC ..... 473/324, 327, 345
See application file for complete search history.

(56) References Cited

U.S. PATENT DOCUMENTS 4,431,192 A * 2/1984 Stuff, Jr. ..... A63B 53/04 473/327
4,444,392 A * 4/1984 Duclos ..... A63B 53/04 473/290
4,653,756 A * 3/1987 Sato ..... A63B 53/04 473/327
4,762,322 A * 8/1988 Molitor ..... A63B 53/04 273/DIG. 8
D412,729 S * 8/1999 Woodward ..... D21/743
6,315,678 B1 * 11/2001 Teramoto ..... A63B 53/00 473/291
6,623,374 B1 * 9/2003 Helmstetter ..... A63B 53/04 473/291
6,773,360 B2 8/2004 Willett et al.
6,800,038 B2 10/2004 Willett et al.
6,824,475 B2 11/2004 Burnett et al.
D506,518 S * 6/2005 Jones ..... D21/736
6,997,820 B2 2/2006 Willett et al.
7,066,832 B2 6/2006 Willett et al.
7,128,660 B2 * 10/2006 Gillig ..... A63B 53/0466 473/324
7,140,974 B2 11/2006 Chao et al.
7,147,570 B2 * 12/2006 Toulon ..... A63B 53/00 473/290
7,166,040 B2 1/2007 Hoffman et al.
(Continued)

*Primary Examiner* — William Pierce
(74) *Attorney, Agent, or Firm* — Klarquist Sparkman, LLP

(57) ABSTRACT

A golf club head having good forgiveness and playability includes a body having an interior cavity, favorable aerodynamic profile and favorable CG location. The club head may include a crown having a peripheral edge located low relative to a ground plane, stepped down crown and overlying shroud, generally flat sole, inverted aft skirt section, aft cavity, cantilevered lightweight shroud, and/or two interior chambers, one of which may have an external opening.

5 Claims, 9 Drawing Sheets

(56) References Cited

U.S. PATENT DOCUMENTS 7,186,190 B1 3/2007 Beach et al.
7,223,180 B2 5/2007 Willett et al.
7,267,620 B2 9/2007 Chao et al.
7,407,447 B2 8/2008 Beach et al.
7,410,425 B2 8/2008 Willett et al.
7,410,426 B2 8/2008 Willett et al.
7,419,441 B2 9/2008 Hoffman et al.
7,448,963 B2 11/2008 Beach et al.
7,452,285 B2 11/2008 Chao et al.
7,530,904 B2 5/2009 Beach et al.
7,540,811 B2 6/2009 Beach et al.
7,568,985 B2 8/2009 Beach et al.
7,578,753 B2 8/2009 Beach et al.
7,591,738 B2 9/2009 Beach et al.
7,621,823 B2 11/2009 Beach et al.
7,628,707 B2 12/2009 Beach et al.
7,632,194 B2 12/2009 Beach et al.
7,713,142 B2 5/2010 Hoffman et al.
7,717,804 B2 5/2010 Beach et al.
7,717,805 B2 5/2010 Beach et al.
7,744,484 B1 6/2010 Chao
7,775,905 B2 8/2010 Beach et al.
7,846,041 B2 12/2010 Beach et al.
7,874,936 B2 1/2011 Chao
7,874,937 B2 1/2011 Chao
7,874,938 B2 1/2011 Chao
7,963,861 B2 6/2011 Beach et al.
RE42,544 E 7/2011 Chao et al.
7,985,146 B2 7/2011 Lin et al.
8,012,038 B1 * 9/2011 Beach ..... A63B 53/0466 473/329
8,025,587 B2 12/2011 Beach et al.
8,070,621 B2 * 12/2011 Nakano ..... A63B 53/0466 473/290
8,083,609 B2 12/2011 Burnett et al.
8,088,021 B2 1/2012 Albertsen et al.
8,096,897 B2 1/2012 Beach et al.
8,162,775 B2 * 4/2012 Tavares ..... A63B 53/0466 473/327
8,235,831 B2 8/2012 Beach et al.
8,272,974 B2 * 9/2012 Mickelson ..... A63B 53/0466 473/314
8,303,431 B2 11/2012 Beach et al.
8,337,319 B2 12/2012 Sargent et al.
8,353,786 B2 1/2013 Beach et al.
8,444,505 B2 5/2013 Beach et al.
8,540,586 B1 9/2013 Albertsen et al.
8,550,936 B1 10/2013 Burnett et al.
8,574,094 B2 * 11/2013 Nicolette ..... A63B 53/047 473/287
8,597,137 B1 12/2013 Albertsen et al.
8,602,909 B1 12/2013 Burnett et al.
8,628,434 B2 1/2014 Chao
8,734,269 B2 5/2014 Burnett et al.
8,734,271 B2 5/2014 Beach et al.
8,753,224 B1 * 6/2014 Kim ..... A63B 53/0466 473/327
8,771,101 B2 7/2014 Albertsen et al.
8,777,773 B2 7/2014 Burnett et al.
8,858,359 B2 10/2014 Willett et al.
8,870,678 B2 10/2014 Beach et al.
8,979,671 B1 * 3/2015 DeMille ..... A63B 53/0466 473/334
9,033,821 B2 5/2015 Beach et al.
9,149,693 B2 * 10/2015 Stites ..... A63B 53/0466
9,393,471 B2 * 7/2016 Beno ..... A63B 53/06
9,421,438 B2 * 8/2016 Beno ..... A63B 53/06
9,446,294 B2 * 9/2016 Oldknow ..... A63B 53/06
9,452,327 B2 * 9/2016 Willett ..... A63B 53/06
2001/0041625 A1 * 11/2001 Satoh ..... A63B 53/04 473/282
2003/0050130 A1 * 3/2003 Wade ..... A63B 53/02 473/287
2005/0075185 A1 * 4/2005 Green ..... A63B 53/0487 473/240
2005/0277486 A1 * 12/2005 Hyman ..... A63B 53/047 473/340
2007/0004534 A1 * 1/2007 Lee ..... A63B 53/0487 473/340
2007/0054751 A1 * 3/2007 Breier ..... A63B 53/0466 473/334
2008/0149267 A1 6/2008 Chao
2008/0182681 A1 * 7/2008 Yokota ..... A63B 53/0466 473/350
2009/0163289 A1 6/2009 Chao
2009/0247313 A1 * 10/2009 Nakano ..... A63B 53/0466 473/290
2010/0273566 A1 * 10/2010 Matsunaga ..... A63B 53/00 473/290
2011/0152000 A1 6/2011 Sargent et al.
2011/0281664 A1 * 11/2011 Boyd ..... A63B 53/0466 473/327
2011/0312437 A1 12/2011 Sargent et al.
2012/0071264 A1 3/2012 Beach et al.
2012/0122601 A1 5/2012 Beach et al.
2012/0258818 A1 10/2012 Beach et al.
2013/0123040 A1 5/2013 Willett et al.
2014/0080622 A1 3/2014 Sargent et al.
2014/0080628 A1 3/2014 Sargent et al.
2015/0005095 A1 1/2015 Ehlers
2016/0001146 A1 1/2016 Sargent et al.
2016/0059093 A1 3/2016 Nielson et al.

* cited by examiner

HOLLOW GOLF CLUB HEAD WITH STEP-DOWN CROWN AND SHROUD FORMING SECOND CAVITY

CROSS REFERENCE TO RELATED APPLICATION

This application claims the benefit of U.S. Provisional Application No. 62/096,605, which was filed on Dec. 24, 2014, and is incorporated herein by reference in its entirety.

FIELD

The present disclosure relates to a golf club head, and more specifically to a wood-type club head such as a driver.

BACKGROUND

Golfers prefer golf clubs that exhibit performance characteristics such as forgiveness and playability. One measure of "forgiveness" can be defined as the ability of a golf club head to reduce the effects of mis-hits, e.g., hits resulting from striking the golf ball at a less than ideal impact location on the golf club head, on flight trajectory and shot distance. Greater forgiveness of the golf club head generally equates to a higher probability of hitting a straight golf shot. "Playability" can be defined as the ease with which a golfer can use the golf club head for producing accurate golf shots.

Golf club forgiveness is directly affected by the moments of inertia of the golf club head. A moment of inertia is a measure of the club head's resistance to twisting about the golf club head's center-of-center gravity, for example on impact with a golf ball. In general, a moment of inertia of a mass about a given axis is proportional to the square of the distance of the mass away from the axis. In other words, increasing the distance of a mass from a given axis results in an increased moment of inertia of the mass about that axis. Higher golf club head moments of inertia result in lower golf club head rotation on impact with a golf ball, particularly on off-center impacts with a golf ball, e.g., mis-hits. Lower rotation in response to a mis-hit results in a player's perception that the club head is forgiving. Moreover, higher moments of inertia typically result in greater ball speed on impact with the golf club head, which can translate to increased golf shot distance.

SUMMARY

The application describes a metal wood-type (or hybrid-type) golf club having a highly positioned upper surface to provide a favorable aerodynamic profile and counterbalancing features to maintain a relatively low CG and high MOT.

Different features and embodiments are described including a crown having a peripheral edge in relative close proximity to a ground plane reference, crown made as a separate piece from a lighter weight material than the rest of the club head body, inverted aft cavity, flatter sole, extension member attached to an underside of a rear portion of the sole to add mass low and back on the club body, stepped down crown in combination with an overlying lightweight shroud to maintain a favorable aerodynamic profile, shroud that is cantilevered along at least a portion of its length and creates an open cavity between the shroud and stepped down crown, and/or one or more ribs in the interior of the body to provide selective reinforcement and tune acoustic properties of the club head body.

Other features and embodiments include a golf club head having one or more of the following features in combination:

- a crown portion terminating at a peripheral ledge having a lowest point at a mid-face cross section that is no greater than 11.1 mm, 11.9 mm, 12.1 mm or 12.3 mm from the ground plane;
- an inverted skirt portion;
- a drop down crown portion;
- a shroud overlying at least a portion of the crown portion;
- an interior having at least two enclosed chambers with one chamber having an interior volume of about 20 to 50% of the volume of the other chamber;
- a drop contour area of about 1600 to 7800 $mm^2$, 3000 to 6000 $mm^2$ or 4000 to 5000 $mm^2$;
- aft cavity that projects into the head's interior cavity about 20%, 30%, 40%, 50% or 60% of the depth of the club head;
- open aft cavity that defines a volume of at least 10%, 20%, 30%, 40% or 50% of the club head's enclosed interior volume;
- a drop down crown wherein at least 30%, 40%, 50% or 60% of the crown's front to back length is located below a geometric center of the strike plate;
- a drop down crown and a shroud wherein the shroud overlies at least 50%, 60%, 70%, 80% or 90% of the crown's front to back length;
- a Delta 1 of about 8 to 28 mm, preferably 11 to 25 mm or more preferably about 14 to 22 mm;
- a CG Projection of about −3 to 7 mm, −1 to 5 mm or 0 to 4 mm;
- a CGz of about 2 to −10 mm, 0 to −8 mm or −2 to −6 mm;
- a Z-up of about 20 to 36 mm, 23 to 33 mm or 25 to 31 mm;
- Ixx of about 200 to 450 $kg \cdot mm^2$, 230 to 390 $kg \cdot mm^2$ or 260 to 320 $kg \cdot mm^2$;
- Izz of about 300 to 600 $kg \cdot mm^2$, 330 to 530 $kg \cdot mm^2$ or 360 to 490 $kg \cdot mm^2$;
- two-piece construction including as one piece a main body, dropped down crown portion and sole portion made from a metal alloy (such as titanium alloy, steel alloy, aluminum alloy or magnesium alloy), and as a second piece a shroud made from a lightweight material (such as composite material, glass fiber reinforced polymers (GFRP), carbon fiber reinforced polymers (CFRP), metal matrix composites (MMC) or other polymers). The first piece may be cast and may include as an integral part of the cast piece a strike plate; and/or other features described in the detailed description.

The foregoing and other objects, features, and advantages of the invention will become more apparent from the following detailed description, which proceeds with reference to the accompanying figures.

BRIEF DESCRIPTION OF THE DRAWINGS

The present disclosure is illustrated by way of example and not limitation in the figures of the accompanying drawings in which like references indicate similar elements.

DETAILED DESCRIPTION

Various embodiments and aspects of the disclosure will be described with reference to details discussed below, and the accompanying drawings will illustrate the various embodiments. The following description of the drawings is illustrative of the disclosed embodiments and not to be construed as limiting the disclosure. Numerous specific details are described to provide a thorough understanding of various embodiments of the present disclosure. However, in certain instances, well-known or conventional details are not described in order to provide a concise discussion of embodiments of the present disclosure.

Figure 1:
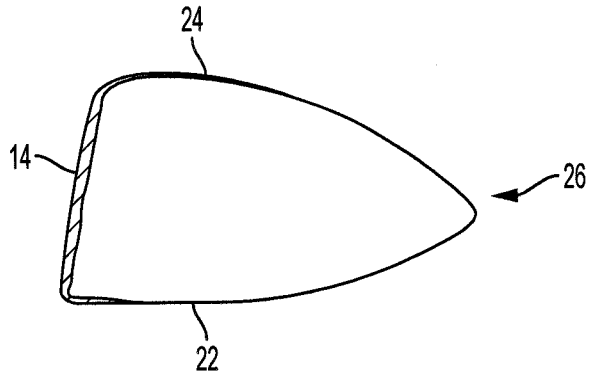
FIG. 1 is a vertical cross-sectional view of a conventional driver-type golf club head.

A typical metal-wood golf club such as a fairway wood or driver includes a hollow shaft having a lower end to which a hollow club head is attached. FIG. 1 illustrates a conventional driver-type club head having a hollow body to which a face place, or strike plate 14, is attached or integrally formed. The body typically includes a hosel (see hosel 16 in FIGS. 12, 13) that extends generally upward and is connected to the shaft (not shown) of the club head. The body also includes a heel region situated close to the hosel (e.g., heel region 18 in FIG. 13), a toe region situated opposite the heel region (e.g., toe region 20 in FIG. 13), a sole (lower) region 22, and a crown (upper) region 24. A skirt portion extends around the periphery of the club head between the sole 22 and crown 24 and excluding the strike plate 14. In some embodiments the skirt portion defines a transition area between the sole and crown, and overlaps portions of both. The body bears most of the impact load imparted to the strike plate 14 when the club head strikes a golf ball. The strike plate 14 defines a front surface or strike face that actually contacts the golf ball. Opposite the front surface, the club head has a rear or aft skirt portion 26 that bridges the space between the heel and toe regions of the club head and is the most remote portion of the club head from the strike plate 14.

The body may be made of a metal alloy (e.g., an alloy of titanium, an alloy of steel, an alloy of aluminum, and/or an alloy of magnesium), but also can be made of a composite material, such as a graphitic composite, a ceramic material, or any combination thereof. The crown, sole and skirt can be integrally formed using a technique such as molding, cold forming, casting, and/or forging. The strike plate can be integrally formed with the body or may be a separate piece attached to the body. The strike plate can be made of a composite material, metal alloy (e.g., titanium, steel, aluminum, and/or magnesium), ceramic material or a combination of composite, metal alloy and/or ceramic materials. Strike plates made at least partially of a composite material are described in U.S. Pat. Nos. 7,267,620, 7,140,974, 7,874,936, 7,874,937, and 7,874,938, which are incorporated by reference herein in their entirety. Further, the strike plate can have a variable thickness, as described in U.S. Pat. Nos. 6,997,820, 6,800,038, 6,824,475, and 7,066,832, which are incorporated by reference herein in their entirety. See, for example, the strike plate 14*k* in FIG. 14

The mass of the club head is distributed so as to improve the forgiveness and other characteristics of the head. Forgiveness on a golf shot is generally maximized by configuring the golf club head such that the center of gravity ("CG") of the golf club head is optimally located and the MOI of the golf club head is maximized. For example, it can be desirable to configure the CG lower on the club head, nearer the sole. One countervailing factor however is that a relatively high crown provides a more desirable aerodynamic profile for the club. But a high crown, though desirable, also works against efforts to maintain a lower CG. The aerodynamics of golf club heads are discussed in more detail in U.S. Pat. Nos. 8,777,773, 8,088,021, 8,540,586, 8,858,359, 8,597,137, 8,771,101, 8,083,609, 8,550,936, 8,602,909, and 8,734,269, the teachings of which are incorporated by reference herein in their entirety.

Various different MOI values may be used to characterize the golf club. For example, MOI about the vertical axis (Izz) and MOI about the heel toe axis (Ixx). Golf club head moments of inertia are typically defined about 3 axes extending through the golf club head CG: (1) a CG z-axis extending through the CG in a generally vertical direction relative to the ground; (2) a CG x-axis extending through the CG in a heel-to-toe direction generally parallel to the strike plate and generally perpendicular to the CG z-axis; and (3) a CG y-axis extending through the CG in a front-to-back direction and generally perpendicular to the CG x-axis and the CG z-axis. The CG x-axis and the CG y-axis both extend in a generally horizontal direction relative to the ground when the club head is at the normal address position. Typically, however, the MOI about z-axis (Izz) is most relevant to club head forgiveness. The MOI about the x-axis (Ixx) also is important, especially at higher club head volumes, while the MOI about the y-axis has less influence on golf club forgiveness.

To achieve higher MOI's, the mass of the club head can be distributed, as much as possible, strategically around the periphery of the club head. The total mass of the club head can be considered the club head's "mass budget." It is axiomatic that at least some of the mass be dedicated to achieving the required strength and structural support of the club head. This is termed "structural" mass. Any mass remaining in the budget is called "discretionary" or "performance" mass, which can be distributed about the club head to maximize performance. Mass shift, properly executed, may be able to maximize Izz and Ixx together, rather than sacrificing one for the sake of the other.

The conventional metal-wood driver illustrated in FIG. 1 shows the enclosed hollow body of the club head, which is defined as the sole 22 curves upwardly and the crown 24 curves downwardly to join one another. The sole and crown generally are concave surfaces that are inverted with respect to one another and join one another along the skirt area.

Figure 2:
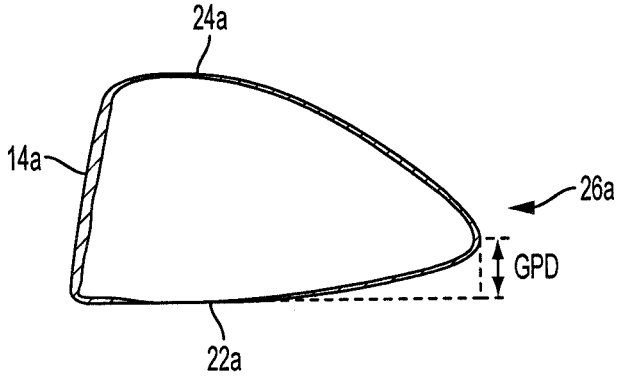
FIG. 2 is a vertical cross-sectional view of a driver-type golf club head having an extended crown according to one embodiment of the present disclosure.

The embodiment of FIG. 2 illustrates a club head having a strike plate 14*a*, sole 22*a*, crown 24*a*, and aft skirt portion 26*a*. As one example, the entire head body may be made from a titanium or titanium alloy although other materials may be used as described herein. The crown 24*a* drops down more steeply (or creates a steeper downward arc) than the design illustrated in FIG. 1, creating a "flatter" sole 22*a*. This in turn creates an aft skirt portion 26*a* that is lower than the aft skirt portion shown in FIG. 1.

It also means that the crown's peripheral edge (and thus a portion of the crown's surface area, especially in the rear or aft region) is positioned relatively low with respect to a reference ground plane. In one embodiment, the distance from the ground plane to the lowest point on crown 24*a* in a mid-face cross-section, referred to as GPD in FIG. 2, is no greater than about 11.9 mm. The distance from the ground plane to the lowest point on crown at another location (along a side peripheral edge of the crown for example) may be even less, such as no greater than about 11.1 mm for example.

Figure 3:
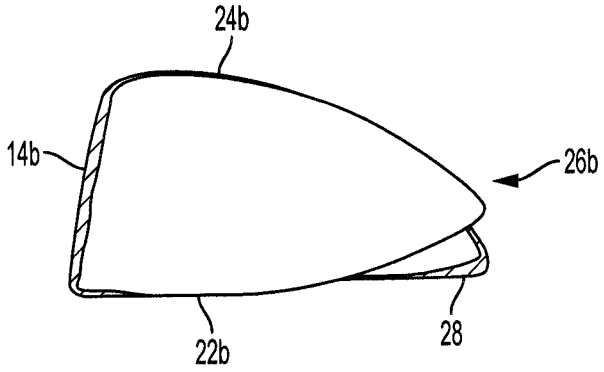
FIG. 3 is a vertical cross-sectional view of a driver-type golf club head according to an alternative embodiment.

The embodiment of FIG. 3 is similar in shape and proportion to the club head of FIG. 1, and includes a strike plate 14*b*, sole 22*b*, crown 24*b*, and aft skirt portion 26*b*. The club head further includes an aft extension 28 attached to an aft portion of the sole 22*b* by adhesive bonding or other securing means. The extension 28 generally has two leg portions, one of which extends generally parallel to the ground plane on which the club head rests in the address position and the other of which is coupled to a raised portion of the sole proximate to the aft skirt portion 26*b*.

The extension 28 adds mass low and aft on the club head and thereby shifts the CG of the club head in a direction that is lower and more rearward. A CG shifted lower on the CG z-axis and more rearward on the CG y-axis can help improve forgiveness and playability of the club head in many designs.

Figure 4:
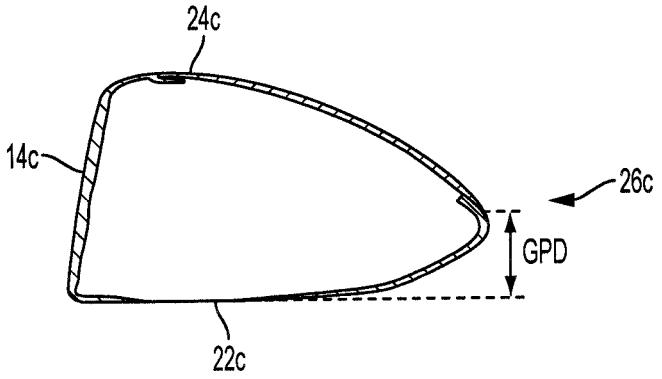
FIG. 4 is a vertical cross-sectional view of a driver-type golf club head according to another alternative embodiment having an extended crown.

FIG. 4 illustrates an alternative embodiment having a strike plate 14*c*, sole 22*c*, crown 24*c*, and aft skirt portion 26*c*. It further illustrates that the crown 24*c* may be a separate piece that is secured to the club head body, rather than an integral extension or integral part of the club head body. In this embodiment, the crown 24*c* easily can be made of a different material, such as a graphitic composite, than the rest of the club head body. In this way, the crown can be made lighter and the resulting discretionary mass savings strategically allocated to other parts of the body. By way of example, an upper portion of the strike plate 14*c* may be formed to create a ledge or shelf to seat (or receive) a leading edge of the crown 24*c*. The ledge or shelf creates a recess that approximates the thickness of the crown 24*c* to provide a smooth transition surface from the upper portion of the strike plate 14*c* to the crown 24*c*. A trailing edge of the crown may be secured to the sole in the aft skirt portion area by an internal lap joint in which the crown 24*c* and sole 22*c* overlap. The crown 24*c* may be secured at its leading and trailing edges to the head body by an adhesive bond or other known fastening techniques.

The crown 24*c* is extended downwardly compared to typical crowns, such that the crown's peripheral edge drops down to a lower point before joining the upturned sole 22*c*. This configuration promotes a flatter sole and moves a portion of the crown's peripheral edge closer to the bottom of the sole. The distance between the crown's peripheral edge and the closest point to a ground plane on which the club head rests in an address position is designated GPD for "ground plane distance." The GPD preferably is no greater than about 11.9 mm in one embodiment, as measured from the crown's lowest point in a mid-face cross-section as shown in FIG. 4. The GPD at other points on the crown's peripheral edge (along a toe or heel edge of the crown for example) may be even less, such as no greater than about 11.1 mm for example. In other embodiments, the GDP at the mid-face cross-section (see FIG. 4) is no greater than about 12.3 mm, no greater than about 12.1 mm or no greater than about 11.7 mm.

Figure 5:
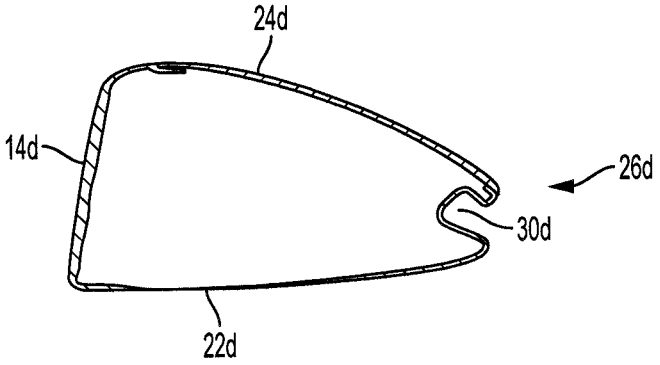
FIG. 5 is a vertical cross-sectional view of a driver-type golf club head according to an alternative embodiment.

FIG. 5 illustrates an alternative embodiment having a strike plate 14*d*, sole 22*d*, composite (for example) crown 24*d*, and aft skirt portion 26*d*. The crown 24*d* preferably is a separate piece affixed to the head body using the recess and internal lap joint technique described in connection with FIG. 4. In contrast to FIG. 4, however, the illustrated embodiment has an inverted aft skirt portion 26*d* that creates an aft cavity 30*d*. The aft cavity 30*d* is created by forming the aft skirt portion in an "S" configuration and securing an upper edge of the aft skirt portion to the crown 24*d* using an internal lap joint as described above.

The aft cavity 30*d* has an opening or mouth that projects (at least in part) generally rearwardly. The aft cavity itself is relatively shallow compared to the size and volume of the club head body's large hollow interior. The aft cavity projects into the hollow interior a modest fraction of the head's depth from front to back as, for example, about ⅛ of the depth. The geometry and position of the aft cavity allows a large surface area of the sole 22*d* to remain relatively flat and close to the ground plane. The flatter sole contributes to a lower CG for the head body, promoting better performance. In addition, the configuration shown allows the trailing edge of the crown to terminate closer to the ground plane (i.e., smaller GDP) in a way that also promotes ease of manufacture.

Figure 6:
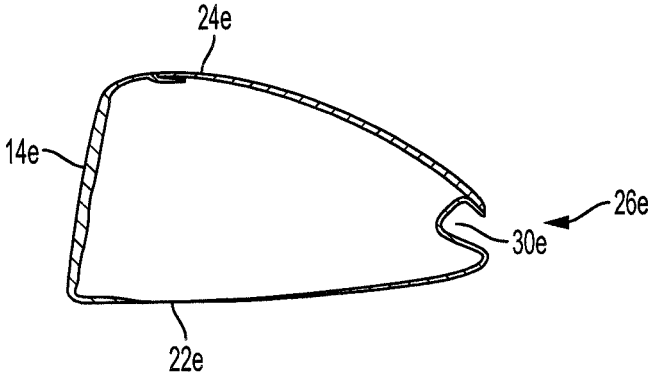
FIG. 6 is a vertical cross-sectional view of a driver-type golf club head according to an alternative embodiment.

FIG. 6 illustrates an alternative embodiment having a strike plate 14*e*, sole 22*e*, composite (for example) crown 24*e* and inverted aft skirt portion 26*e*. Except as noted, this embodiment is similar in construction to the embodiment of FIG. 5 and includes a separate crown 24*e*, relatively flat sole 22*e*, and aft cavity 30*e*. In contrast to the FIG. 5 embodiment, however, the aft cavity 30*e* formed by the inverted skirt portion 26*e* is created by forming the aft skirt portion in a "C" configuration and securing an upper edge of the aft skirt portion to the crown 24*e* using an external lap joint. In other words, the aft skirt portion undergoes fewer turns such that the skirt edge attached to the crown 24*e* at the external lap joint is external to the hollow interior of the club head body, rather than internal as shown in FIG. 5. In both embodiments, however, the trailing edge of the crown in the aft region is directly supported by and attached to the inverted aft skirt portion.

Like the FIG. 5 embodiment, the aft cavity 30*e* shown in FIG. 6 is relatively shallow and projects into the hollow interior about ⅛ of the depth of the club head body. Similarly, the FIG. 6 embodiment has a relatively flat sole for much of its length from front to back, contributing to a lower CG for the club head. The FIG. 6 embodiment also positions the crown closer to the ground plane (i.e., smaller GPD) in a way that is simpler to manufacture.

Figure 7:
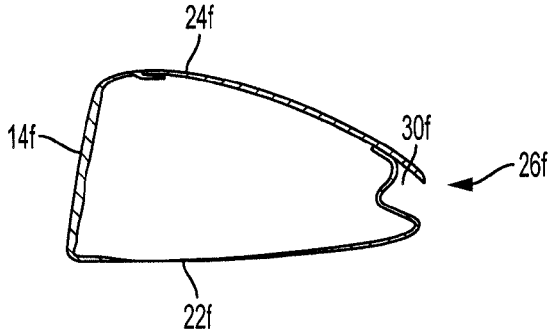
FIG. 7 is a vertical cross-sectional view of a driver-type golf club head according to an alternative embodiment.

FIG. 7 illustrates an embodiment having a strike plate 14*f*, sole 22*f*, composite (for example) crown 24*f*, and aft skirt portion 26*f*. Except as noted, this embodiment is similar in construction to the embodiments of FIGS. 5 and 6, and includes a separate (non-integral) crown 24*f*, relatively flat sole 22*f*, and aft cavity 30*f*. However, in contrast to FIGS. 5 and 6, the aft cavity 30*f* formed by the inverted skirt portion 26*f* is created by forming the aft skirt portion in a "L" configuration and securing an upper edge of the aft skirt portion to the crown 24*f* using an internal lap joint located a distance inset from an aft peripheral edge of the crown 24*f*. In other words, the inverted skirt portion terminates at an inward turn to create an internal lap joint, and the inset attachment of the aft skirt portion to the crown creates a short cantilevered section at the aft peripheral edge of the crown. The aft cavity 30*f*, however, continues to have a rearwardly directed opening (or mouth) and defines a volume that is a small fraction of the club head's enclosed interior volume. The aft cavity 30*f* projects into the hollow interior a small fraction of the depth of the club head body as, for example, about ⅐ to ⅛ of the depth of the club head from its forward-most edge to its rearward-most edge. As FIG. 7 shows, an aft portion of the crown 24*f* is cantilevered and not directly coupled to a support element. As with embodiments described above, the sole 22*f* is relatively flat from front to back and remains in contact with or close to the ground plane on which the club head rests in the address position, contributing to a lower CG of the club head.

Figure 8:
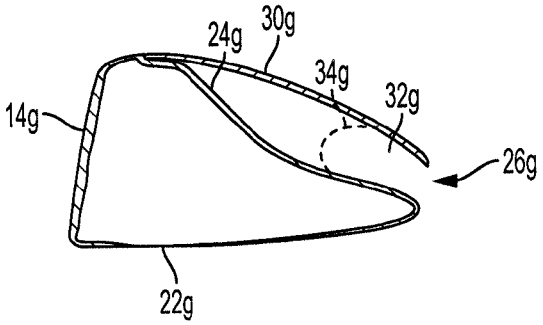
FIG. 8 is a vertical cross-sectional view of a driver-type golf club head according to an alternative embodiment.

FIG. 8 illustrates an alternative embodiment having a strike plate 14*g*, sole 22*g*, crown 24*g*, and aft skirt portion 26*g*. In contrast to some of the embodiments just discussed, the crown 24*g* is an integral extension of the main club head body and steps down moderately as the crown extends rearwardly toward the aft skirt portion 26*g*. Unlike prior embodiments, the crown 24*g* drops down and presents a generally convex surface to the hollow interior of the club head, rather than a concave surface as with the embodiments described above. In the area where the crown 24*g* joins the strike plate 14*g*, an annular recess or ledge is formed in the crown (similar to the one heretofore described) to receive a shroud 30*g* which provides a smooth arcuate rearward extension of the strike plate 14. The shroud generally occupies the position of a traditionally situated crown. The shroud 30*g* preferably is made from a lightweight composite material or other materials lighter than the material used for the rest of the club head body. As FIG. 8 shows, the shroud 30*g* has a large cantilevered portion and is supported between its front and aft peripheral edges by a rib 34*g* that extends between and is coupled to both the shroud 30*g* and crown 24*g*. The rib 34*g* may be used to adjust or tune acoustic properties of the club head body and may have different curvatures or other shapes, may be coupled to the shroud and crown at other locations, may be formed of different materials, and may have varying material properties such as flexibility, strength, damping and the like.

The step down crown 24*g* and shroud 30*g* create a large cavity 32*g* that defines a much larger volume than prior embodiments and preferably projects far more deeply into what would otherwise be the hollow interior of the club head body. The cavity 32*g* preferably projects inwardly over 50% of the depth of the club head, as measured from the club head body's leading edge to trailing edge. In other embodiments, the aft cavity may project inwardly about 20%, about 30%, about 40% or about 60% of the depth of the club head.

In some embodiments, the open aft cavity 32*g* defines a volume (using an imaginary plane to close the opening between the rearmost point on the sole and rearmost point on the shroud) that is at least 10% of the volume of the club head's enclosed interior, at least 20% of the volume of the club head's enclosed interior, at least 30% of a club head's enclosed interior, at least 40% of the club head's enclosed interior or at last 50% of the club head's enclosed interior.

The club head body of FIG. 8 provides a lowered, step-down or drop crown 24*g* in which a large expanse of the crown's surface (which may be made of titanium, titanium alloy or other material) is dropped or stepped down substantially in comparison to traditional driver crowns, thereby significantly lowering the CG of the club head to enhance performance, forgivability and playability. Such drop down construction, however, can have a deleterious effect on the sound emitted by the club head when a ball is struck as well as on the appearance of the club head (which some golfers may find an unwelcome departure from the traditional look of a driver). The shroud 30*g*, which can be made from a lightweight material such as a composite material, gives the head a more traditional appearance when viewed from above while mitigating the adverse effect caused on the CG by a component situated high on the body of the club head. The shroud and rib 34*g* together also allow the sound and acoustic properties associated with a conventional driver-type club head to be at least substantially replicated. Generally, it is desirable to maintain all peak frequency modes above 3000 Hz, preferably about 3500 to 3700 Hz.

Figure 9:
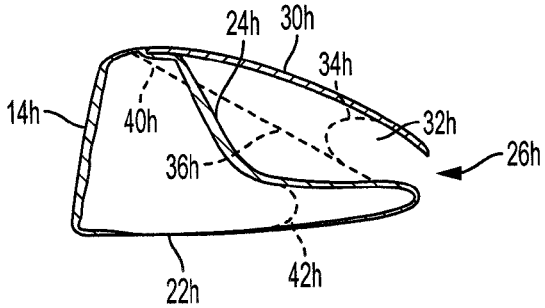
FIG. 9 is a vertical cross-sectional view of a driver-type golf club head according to an alternative embodiment.

FIG. 9 illustrates an alternative embodiment having a strike plate 14*h*, sole 22*h*, step-down crown 24*h* and aft skirt portion 26*h*. Except as noted, the illustrated embodiment is similar to the FIG. 8 embodiment just described. The crown 24*h* (in one embodiment) may be an integral part of the club head body such that the crown 24*h*, strike plate 14*h* and sole 22*h* are made of a common material, such as titanium, titanium alloy or other material. In comparison to the FIG. 8 embodiment, the crown 24*h* has a more extreme stepped down portion starting at a point proximate to an upper edge of the strike plate 14*h*. As the crown 24*h* drops down steeply and extends rearwardly it reaches a mid-section of the club head, where it levels off and eventually joins the sole 22*h* at a skirt portion that is situated relatively low relative to the bottom of the sole (as well as the ground plane on which the club head rests in the address position). In this way, a large surface area of the crown 24*h* (and mass it represents) is positioned much lower in the club head body than traditional crowns, thereby significantly lowering the CG of the club head. Also, unlike conventional crowns, the crown 24*h* presents a substantially convex surface to the enclosed hollow interior of the club head.

As with the FIG. 8 embodiment, in the area where the crown 24*h* joins the strike plate 14*h*, an annular recess or ledge is formed in the crown to receive a shroud 30*h*. The shroud provides a smooth, continuous arcuate extension of the upper portion of the strike plate 14*h*. The shroud 30*h* is preferably made of a composite or other lightweight material and occupies a position and orientation typical of a traditional crown in a driver-type club head. The shroud 30*h* is similar in shape, orientation and curvature to the shroud 30*g* in FIG. 8, and also is highly cantilevered like the shroud 30*g*. In contrast, however, the shroud 30*h* cooperates with the crown 24*h* to define a significantly larger aft cavity 32*h* due to the much steeper stepped-down configuration of the crown 24*h*. The aft cavity 32*h* has a rearwardly facing opening (at least in part) and defines a volume about twice that of the aft cavity 32*g* (the volume being determined by closing the cavity opening with an imaginary plane connecting the closest points between the peripheral edge of the shroud 30*h* and peripheral edge of the sole 22*h*). The aft cavity occupies a volume that preferably is about 30% to 100% of the volume of the underlying main interior chamber of the club head, as defined by the crown 24*h*, strike plate 14*h*, and sole 22*h*.

The club head preferably includes ribs 34*h*, 36*h*, 40*h* and 42*h*. The rib 36*h* is coupled at one end to a relatively flat aft portion of the crown 24*h* and at its other end to a steeply inclined forward portion of the crown 24*h*. The rib 34*h* preferably is coupled at one end to an aft portion of the rib 36*h* and at its other end to an aft portion of the cantilevered shroud 30*h*. The ribs 34*h* and 36*h* are located in the aft cavity 32*h*. The rib 40*h* preferably is located in the head's main interior chamber, and is coupled at one end to a steep forward portion of the crown 24*h* and at its other end to a location proximate to where the crown 24*h* joins the faceplate 14*h*. The rib 42*h* likewise is located in the head's main interior chamber, and preferably is coupled at one end to a relatively flat centrally-located portion of the crown 24*h* and at its other end to the sole 22*h*. It will be appreciated that the ribs 34*h*, 36*h*, 40*h*, 42*h* may have varying physical attributes, such as shape, material, strength, flexibility, damping properties and other material properties, and may be coupled at their ends to alternate locations on various structural components of the club head. For example, in FIG. 9 the ribs 36*h*, 40*h* are shown as substantially linear or planar reinforcing elements while the ribs 34*h*, 42*h* are shown as arcuate linear or curvilinear reinforcing elements.

The ribs provide a way to easily and flexibly reinforce certain parts of the club head and, equally important, adjust or fine tune the acoustic properties of the club head to approximate the acoustic properties of a traditional driver-type club. In addition, the shroud 30*h* gives the club head a look similar to traditional driver-type clubs, especially when viewed from the top, while allowing the mass associated with the crown 24*h* to be lowered considerably, thereby lowering the CG of the club head and improving the club head's forgivability and playability.

Figure 10:
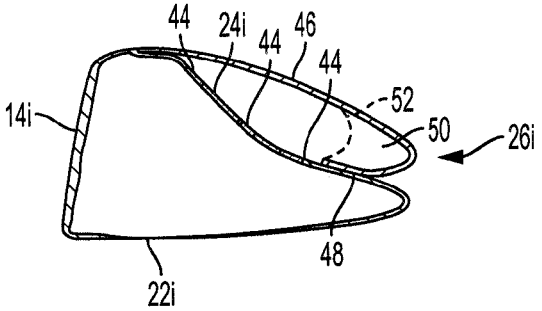
FIG. 10 is a vertical cross-sectional view of a driver-type golf club head according to an alternative embodiment.

FIG. 10 illustrates an alternative embodiment having a strike plate 14*i*, sole 22*i*, step-down crown 24*i* and aft skirt portion 26*i*. The crown 24*i*, like the crown 24*g* of FIG. 8, is an integral extension of the main club head body and steps down moderately as it extends rearwardly toward the aft skirt portion 26*i* and eventually joins the sole 22*i*. The crown 24*i* has a similar configuration as the crown 24*g* and presents a moderate convex surface to the main interior chamber of the club head. Unlike the crown 24*g*, the crown 24*i* preferably has a plurality of openings 44 formed in its surface to reduce the crown's mass.

In the area where the crown 24*i* joins the strike plate 14*i*, an annular recess or ledge is formed in the crown to receive an upper crown 46 (or shroud) which provides a smooth, arcuate surface extending rearwardly from the strike plate 14*i*. The upper crown 46 preferably is made of a composite or other lightweight material and generally occupies the position of a conventionally situated crown. The upper crown 46 also may be considered a shroud because it hides or covers the space overlying the stepped-down crown 24*i*. Unlike the shroud 30*g* or 30*h*, however, the upper crown or shroud 46 is not cantilevered, but rather has an aft section that is turned back on itself by about 180 degrees to form an inverted aft skirt portion 26*i* and is secured by adhesion or otherwise to the crown 24*i* at an internal lap joint 48.

The upper crown or shroud 46 cooperates with the crown 24*i* to define an aft or upper chamber 50. The upper chamber 50 overlies a substantial portion of the club head's main interior chamber as, for example, at least 50% of the front to back length of the main interior chamber. Unlike the aft cavities described above, the upper chamber 50 is fully enclosed and does not have an external rearwardly facing opening or mouth.

The club head may have one or more interior ribs of varying physical or other properties/characteristics, as described above, including, for example, a single arcuate rib 52 joined at one end to the upper crown 46 and at its other end to a location proximate to the lap joint (either by attaching to the turned back portion of the upper crown 46 itself or to the crown 24*i*). It will be appreciated that the rib 52 can be coupled to the club head at other locations or to other structural members as part of a fine-tuning process.

The crown 24*i*'s stepped down or drop-down configuration lowers the CG of the club head and enhances performance. The stepped down crown 24*i* presents a convex surface to the main interior chamber of the club head. The composite upper crown or shroud 46 and its inverted configuration creates a second fully enclosed interior space, cavity or chamber that provides an alternative way of adjusting the acoustic properties of the club head because the club head no longer has a cavity or bay that is open on one or more sides. The holes 44 and variations thereof provide yet another way to flexibly and easily alter the acoustic properties of the club head as well as create discretionary mass savings that can be strategically located elsewhere on the club head body to increase MOI and enhance performance.

Figure 11:
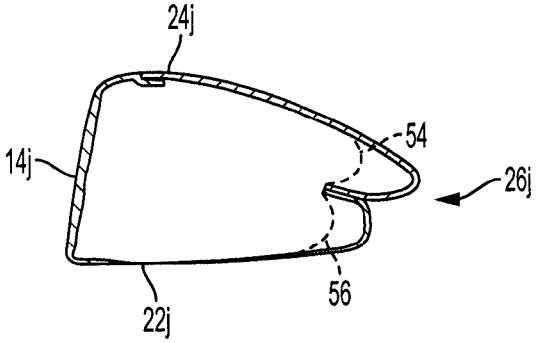
FIG. 11 is a vertical cross-sectional view of a driver-type golf club head according to an alternative embodiment.

FIG. 11 illustrates an alternative embodiment having a strike plate 14*j*, sole 22*j*, cover or upper crown 24*j*, and inverted aft skirt portion 26*j*. This embodiment is similar to the FIG. 10 embodiment in that the crown 24*j* and sole 22*j* both have inverted ends to form the inverted aft skirt portion 26*j* and are joined to one another at an internal lap joint by adhesion (or other known fastening means). The crown 24*j* preferably is a separate piece made from a composite or other lightweight material. Unlike the FIG. 10 embodiment, however, the inverted end of the sole 22*j* does not join a lower stepped-down crown structure to create two interior chambers. Rather, the crown 24*j*, sole 22*j*, and inverted aft portion 26*j* define a single enclosed interior chamber. The interior chamber may be provided with one or more ribs, such as arcuate ribs 56, 58 shown in FIG. 11. The rib 54 preferably is coupled at one end to the crown 24*j* and its other end to an inverted end portion of the crown 24*j* (by adhesive bonding for example). Similarly, the rib 56 may be coupled at one end to the sole 22*j* and at its other end to an inverted end extension of the sole 22*j*. The ribs are used to provide reinforcement within the club body where desired as well as to adjust or tune the acoustic properties of the club head.

It will be appreciated that the inverted aft skirt portion 26*j* may be modified to have various configurations. For example, in FIG. 11 the inverted aft skirt portion 26*j* is shown having a truncated inverted sole that stops short of extending rearwardly as far as the inverted crown. Thus, the inverted crown forming part of the inverted aft skirt portion overhangs the truncated sole in the example shown.

Figure 12:
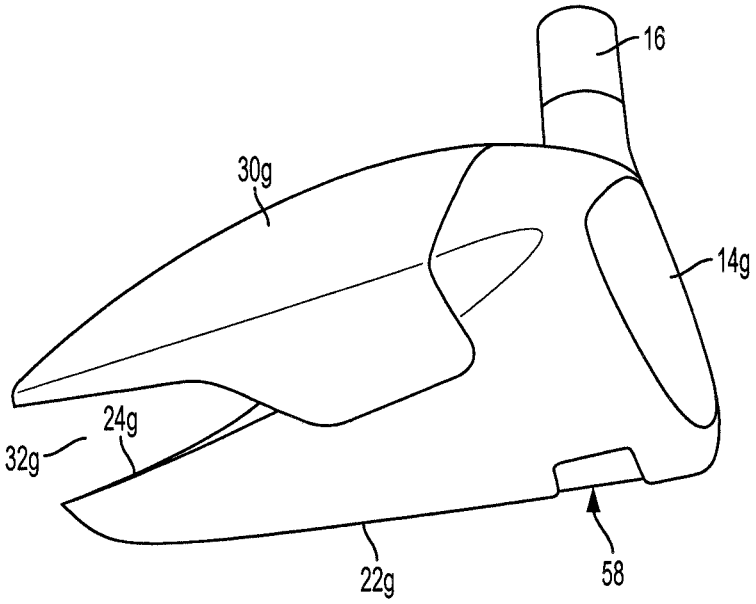
FIG. 12 is a side elevation view of an embodiment similar to FIG. 8, and taken from a toe side of the club head.

FIG. 12 is a toe side view of an embodiment very similar to FIG. 8, and showing the strike plate 14*g*, sole 22*g*, step-down crown 24*g*, and shroud 30*g*. FIG. 12 also shows the hosel 16 used to attach the club head to a shaft. FIG. 12 shows a variation of the FIG. 8 embodiment in which a sole slot 58 is provided in the sole 22*g*. The sole slot 58 may be used to house adjustable weights or other performance enhancing features.

For example, in certain embodiments of the present invention the golf club head may be attached to the shaft via a removable head-shaft connection assembly as described in more detail in U.S. Pat. No. 8,303,431, the entire contents of which are incorporated by reference herein in their entirety. Further in certain embodiments, the golf club head may also incorporate features that provide the golf club heads and/or golf clubs with the ability not only to replaceably connect the shaft to the head but also to adjust the loft and/or the lie angle of the club by employing a removable head-shaft connection assembly. Such an adjustable lie/loft connection assembly is described in more detail in U.S. Pat. No. 8,025,587, U.S. Pat. No. 8,235,831, U.S. Pat. No. 8,337,319, as well as U.S. Publication No. 2011/0312437A1, U.S. Publication No. 2012/0258818A1, U.S. Publication No. 2012/0122601A1, U.S. Publication No. 2012/0071264A1 as well as U.S. application Ser. No. 13/686,677, filed on Nov. 27, 2012, the entire contents of which patent, publications and application are incorporated in their entirety by reference herein.

Figure 13:
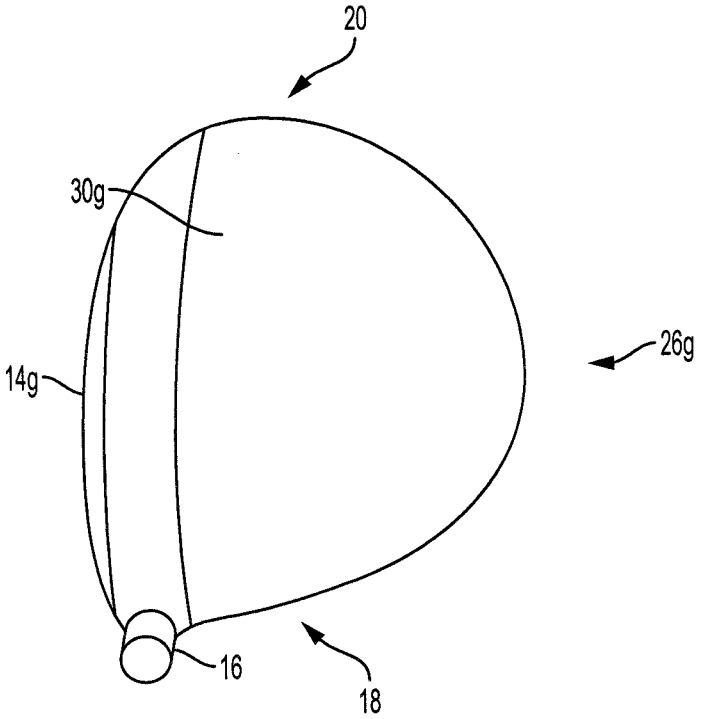
FIG. 13 is a top plan view of the embodiment of FIG. 12.

FIG. 13 is a top view of the club head of FIG. 12 and shows the strike plate 14*g*, hosel 16 and shroud 30*g*. It also illustrates the toe region 20, heel region 18 and aft skirt portion 26*g* of the club head.

The foregoing embodiments provide a highly-positioned crown or shroud to provide a desirable aerodynamic profile for the club head, while maintaining a relatively low CG despite the high crown's (or shroud's) influence on the CG to the contrary. The modest mass of the highly-located shroud/upper crown is offset or countered by providing a lightweight shroud having a mass less than a traditional crown, extending the shroud or crown to have a peripheral edge with a low GPD value such that a portion of the shroud/crown's peripheral surface area is nearer to the ground plane at address position than traditional crowns, providing a flatter sole such that a larger portion of the sole's expanse is maintained in contact with or nearer the ground plane at address position, and/or providing a (lower) crown that steps down such that a large portion of the lower crown's mass is positioned much lower relative to the ground plane compared to traditional crowns. In this way, a relatively low and desirable CG can be achieved even with a highly situated upper crown or shroud in place to promote desirable air flow and aerodynamic properties during the golf swing.

While the foregoing description has been provided in the context of a driver-type golf club head, it will be appreciated that the principles and teachings herein may be applied to other types of "metal-woods," such as fairway wood or hybrid club heads.

It also will be appreciated that each of the disclosed embodiments can be used in combination with other club head features such as sole channels, movable weights, adjustable shafts and the like. For example, the embodiments disclosed may be used in combination with slidable repositionable weights positioned in the sole and/or skirt.

Among other advantages, a slidably repositionable weight facilitates the ability of the end user of the golf club to adjust the location of the CG of the club head over a range of locations relating to the position of the repositionable weight. Further detail concerning the slidably repositionable weight feature is provided in more detail in U.S. Pat. Nos. 7,775,905 and 8,444,505 and U.S. patent application Ser. No. 13/898,313 filed on May 20, 2013, U.S. Patent Application Ser. No. 62/020,972, filed Jul. 3, 2014, and U.S. patent application Ser. No. 14/047,880 filed on Oct. 7, 2013, the entire contents of each of which are hereby incorporated by reference herein in their entirety, as well the contents of U.S. Patent Publication No. 2014/0080622 and U.S. Patent Publication No. 2014/0080628, the contents of which are hereby incorporated by reference herein in their entirety.

Figure 14:
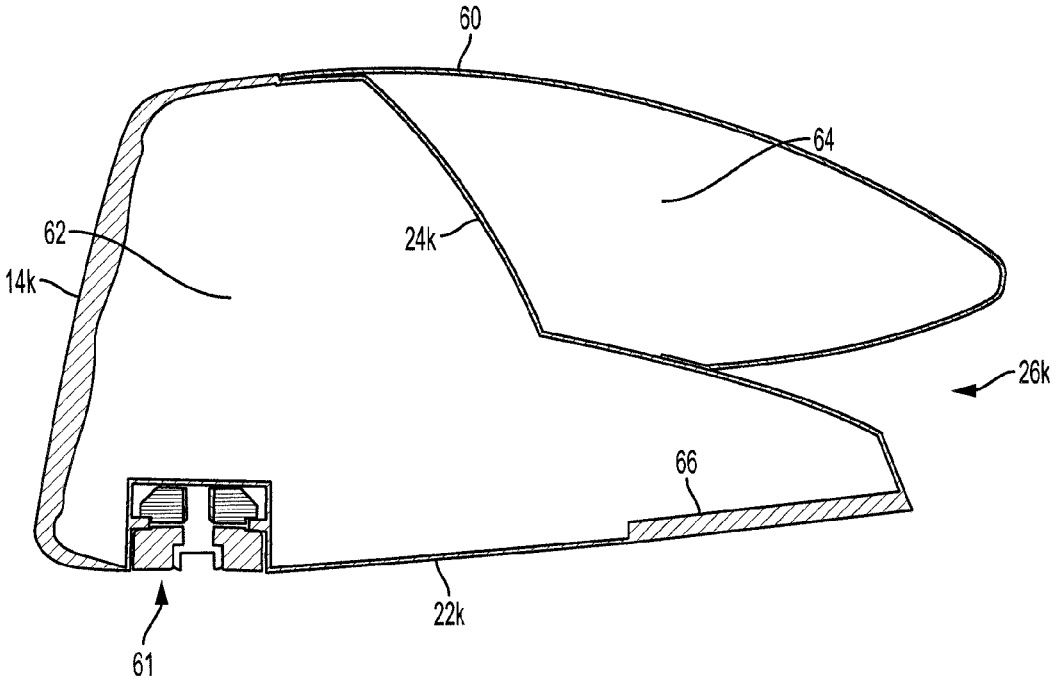
FIG. 14 is a vertical cross-section of a drawer-type golf club head according to an alternative embodiment.

By way of example, FIG. 14 illustrates an alternative embodiment having a strike plate 14*k*, sole 22*k*, step-down crown 24*k*, and aft skirt portion 26*k*, which bears some similarity to the embodiment of FIG. 10. In addition, a slidable weight feature 61 is provided in the sole 22*k* and proximate to the strike plate 14*k*. The crown 24*k*, like crown 24*i*, preferably is an integral extension of the main club head body and steps down steeply as it extends rearwardly toward the aft skirt portion 26*k* and eventually joins sole 22*k*. The crown 24*k* has a steep downwardly extending section that turns at an obtuse angle to join a relatively flat aft section. Though not an arcuate surface like other embodiments, the crown 24*k* still presents a substantially convex-like surface to a primary interior chamber 62 of the club head.

A composite shroud 60 extends rearwardly from a turned upper edge of the strike plate 14*k* to provide a smooth, continuous and relatively high surface to give the club head a desirable aerodynamic profile. The shroud 60 is inverted at the aft end and its end is attached to the crown 24*k* at an internal lap joint. The inverted shroud 60 defines an enclosed secondary interior chamber 64 that at least partially overlies the primary interior chamber 62. The sole 22*k* may be provided with a thickened aft portion 66 to provide additional mass low and aft in the club head and thereby desirably shift the overall CG of the club head still lower and more rearward.

Figure 15A:
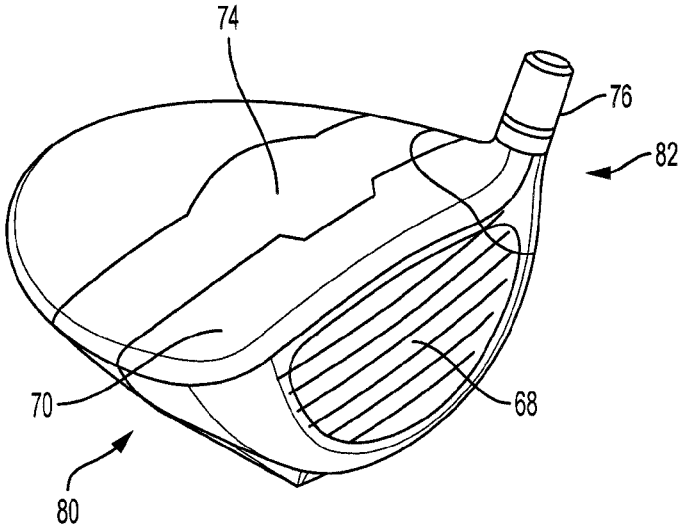
FIG. 15A is a perspective view of a driver-type golf club head according to another alternative embodiment.
Figure 15B:
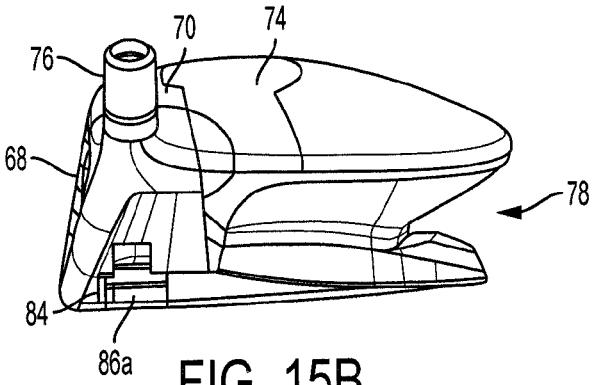
FIG. 15B is a side elevation view of the embodiment of FIG. 15A.
Figure 15C:
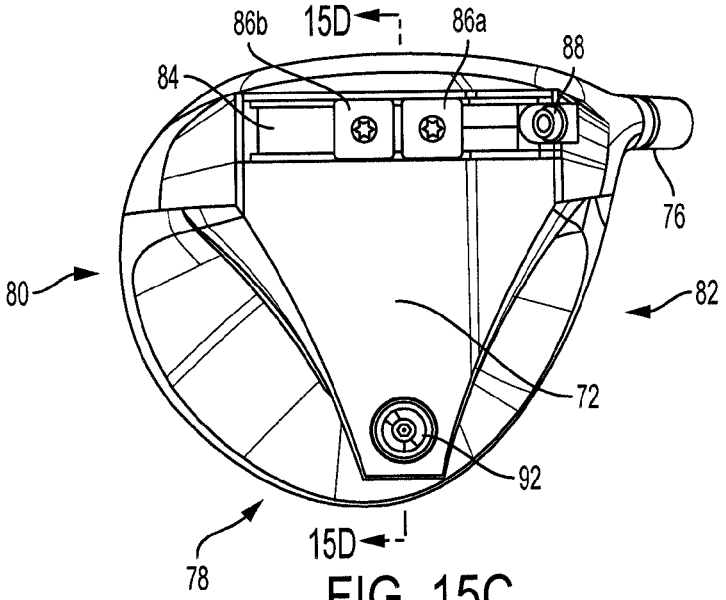
FIG. 15C is a bottom plan view of the embodiment of FIG. 15A.
Figure 15D:
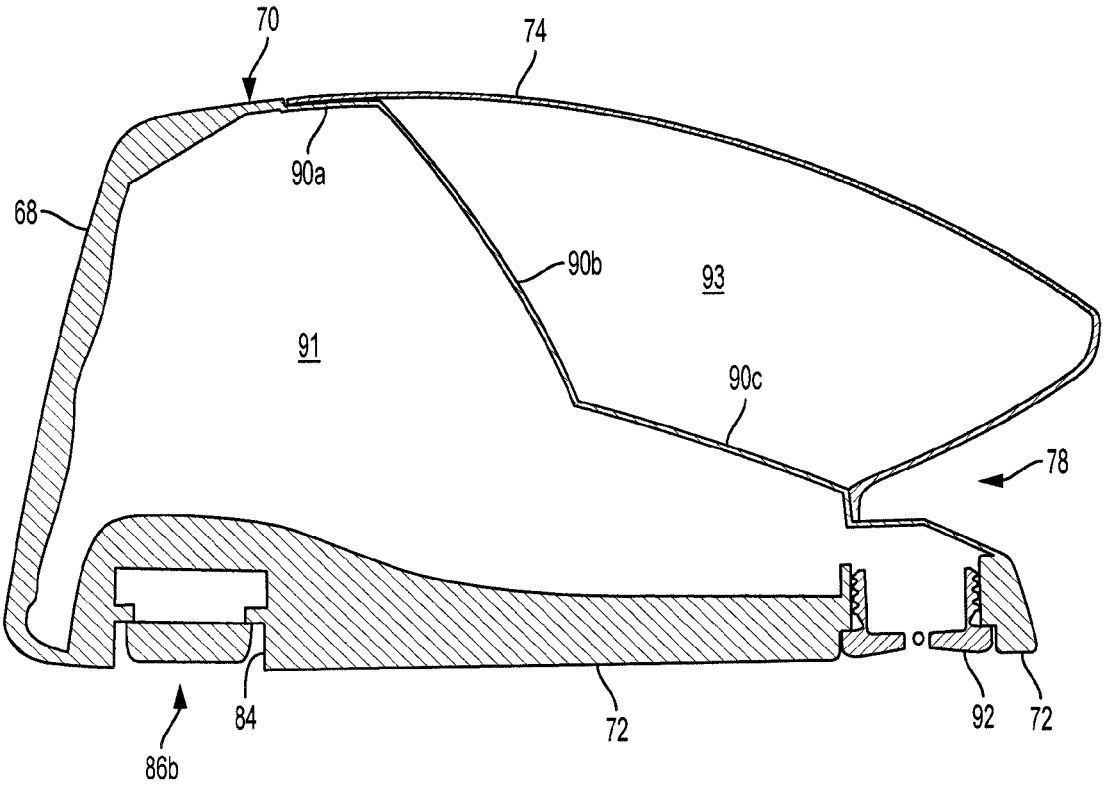
FIG. 15D is a vertical cross-sectional view of the embodiment of FIG. 15A, taken generally through a mid-section of the golf club head.
Figure 15E:
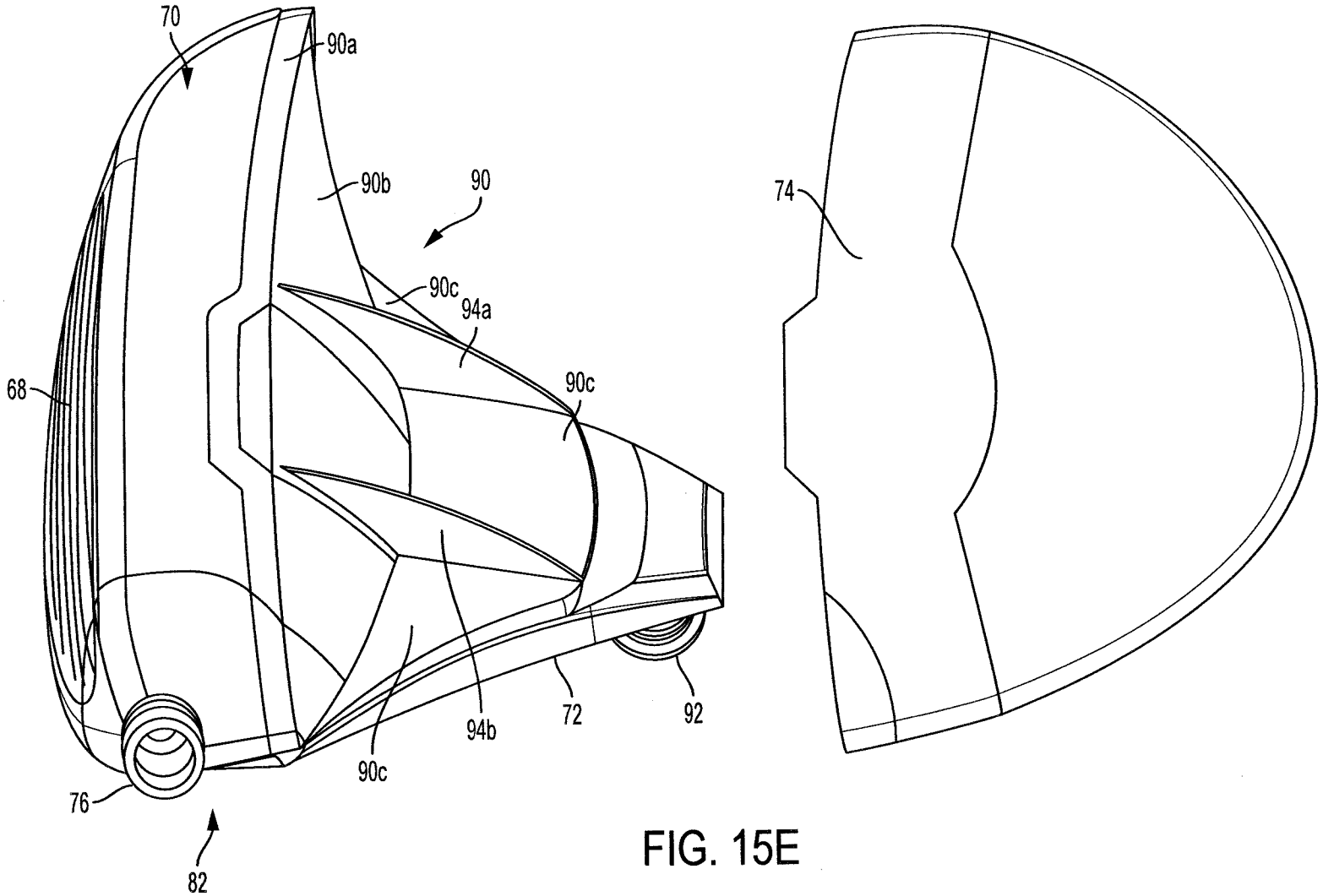
FIG. 15E is an exploded view of two components of the embodiment of FIG. 15A.
Figure 16:
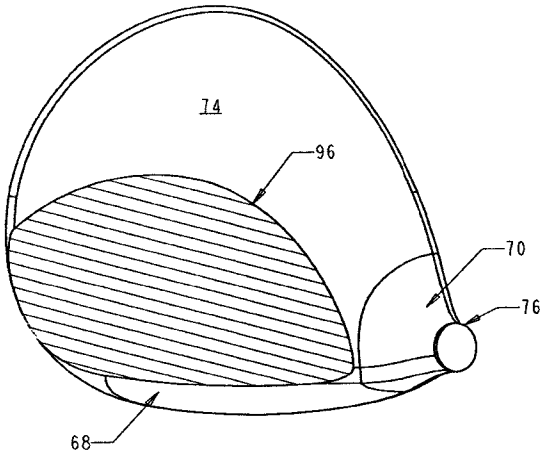
FIG. 16 is a perspective view (largely from above) of the embodiment of FIG. 15 with a portion of the crown removed.
Figure 17:
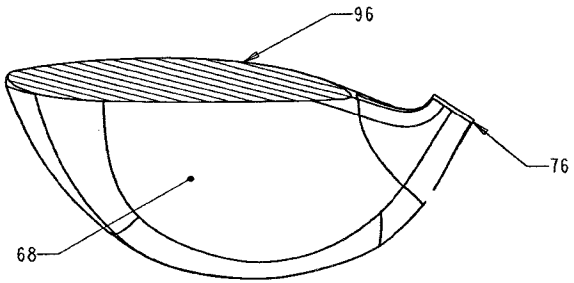
FIG. 17 is a generally front elevation view of the club head of FIG. 16.

FIGS. 15-17 illustrate an alternative embodiment of a two-piece golf club head having a laterally adjustable weight located in a forward sole portion of the club head and a fixed weight located in a rear sole portion of the club head.

FIG. 15A is a perspective view of the club head which includes a strike plate 68, strike plate frame or main body 70, sole 72 (FIG. 15C), shroud 74, hosel 76 and aft skirt portion 78 (FIG. 15B). It also illustrates the head's toe region 80 and opposite heel region 82 proximate to the hosel 76.

FIG. 15B is a heel-side elevation view illustrating that the aft skirt portion 78 and remainder of the skirt portion which wraps around the toe and heel regions of the head may be recessed or inverted (in one embodiment) relative to the full width and depth of the shroud 74. In other words, the shroud 74 may overhang portions of the skirt portion. The head also includes a forwardly-located lateral weight track 84 in the sole in close proximity to the strike plate 68 for mounting one or more laterally adjustable weights 86*a*, 86*b*.

FIG. 15C is a bottom plan view of the head's sole portion and provides a more detailed view of the lateral weight track 84 and adjustable weights 86*a*, 86*b*. If two weights are mounted in the weight track, each may be mounted in various positions closer to or farther from the toe region or heel region. For example, both weights may be secured in place in the middle of the weight track as shown, at one end of the track on the toe side, at one end of the track on the heel side, at opposite spaced apart ends of the track or in other spaced apart locations therebetween to adjust the flight characteristics of the ball. FIG. 15C also illustrates that the club head may include an adjustable lie/loft connection assembly having an adjustment screw 88, as described above.

FIG. 15D is a vertical cross-sectional view taken generally along line 15D-15D of FIG. 15C. The club head includes a lowered or drop-down crown 90 underlying the shroud 74. The crown 90 preferably has a forward flat section 90*a*, relatively steeply sloped intermediate section 90*b* and less steeply sloped rear section 90*c*. In one example, the rear section may include a rearmost tail section having one or more angled segments to join the crown to the sole and/or skirt of the head. The crown preferably presents a generally convex surface to the head's enclosed primary interior chamber 91. The shroud 74 preferably encloses a secondary interior chamber 93 which generally overlies the primary interior chamber and may have an enclosed interior volume of about 20 to 50% of the primary interior's volume.

The intermediate and/or rear section may be perforated to remove mass from the crown 90 while maintaining the crown's integrity as a structural support member of the club head. The perforations (not shown) can have various sizes, shapes and locations to free up discretionary mass that can be allocated elsewhere.

The forward crown section 90*a* preferably is an integral extension of the strike plate frame 70, and is secured by adhesion or otherwise to a forward segment of the shroud 74. The rear section 90*c* of the crown 90 preferably is joined by adhesion or otherwise to a rear portion of the shroud 74 which is bent backwardly on itself (i.e., inverted) to form a cavity or recess at the aft skirt portion 78. The shroud may have other shapes and configurations and may not have an inverted skirt section at all.

FIG. 15D illustrates adjustable weight 86*b* as a one-piece weight but, as described above, weight 86*b* preferably is a two-piece weight in which each piece is releasable fastened together so as to form opposing channels that slideably engage a pair of opposing rails or tracks formed by the weight track 84, with one of the weight pieces located in a chamber above the rails and the other located in a chamber below the rails. A fixed weight 92 is shown removably fastened, such as by threaded engagement, to the sole portion via an opening located at a generally centered, rear location in the sole portion of the club head.

FIG. 15E is an exploded perspective view from above showing the main body or strike plate frame 70 as one piece including the strike plate 68, sole 72 and crown 90, and the shroud 74 as a second piece. The peripheral edges (i.e., top, side and rear edges) of the crown preferably are recessed slightly to form a ledge or shelf to receive corresponding edges of the shroud, such that the shroud surface forms a smooth, continuous transition of the shroud's outer surface with head's main body/frame. The two pieces may be joined together by adhesion or other secure fastening technique. The first piece (main body or strike plate frame) may be made from various materials as described herein but in one preferred embodiment is cast in one piece from a metal alloy (such as titanium alloy, steel alloy, aluminum alloy or magnesium alloy) to provide a strong structural framework or support for the strike plate to withstand the loading caused by a ball impact. The second piece (shroud) may be made from various materials as described herein but in one preferred embodiment may be made from a lightweight material such as a composite material, GFRP, CFRP, MMC, or other polymers, including thermosetting materials, copolymers and elastomers, thereby freeing up discretionary mass to be strategically located elsewhere on the club head (such as low and rearward in the head body) while providing a relative high "phantom" crown-like surface to promote positive aerodynamic properties and a traditional "look" to the club head from above.

The head may be provided with interior ribs in the primary or secondary interior chambers to provide enhanced structural support and rigidity and/or desirable acoustic properties. For example, ribs 94*a*, 94*b* preferably are joined as part of the original cast piece (or alternatively by welding or other fastening techniques) to different portions of the crown 90, such as intermediate section 90*b* and rear section 90*c*. As such, the ribs 94*a*, 94*b* are located in the secondary interior chamber 93. However, ribs in various shapes and sizes may be located in the primary interior chamber and/or at other sites in the secondary interior chamber. Also, the ribs may be perforated to free up mass that may be allocated elsewhere.

As shown in FIGS. 15D and 15E, in one exemplary embodiment at least 50% of the crown 90's front to back length (or depth) is located below a geometric center of the strike plate 68. In other examples, at least 30%, at least 40% or at least 60% of the crown's front to back depth is located below the geometric center of the strike plate. For definitional purposes, a "shroud" is a structure that overlies at least a portion of the crown to cover, cloak, shelter or overlie the crown. The shroud provides a phantom crown-like surface that serves less to provide structural support and reinforcement for the head, and more to provide a highly favorable aerodynamic surface which also looks like a more typical club head profile (especially when viewed from above). The terms lowered crown, step-down crown and drop crown refer to a non-traditional crown that steps down or drops down from the profile of a traditional crown. Traditional crowns generally present a large concave surface to the primary interior chamber of the club head, whereas a lowered, step-down or drop crown presents a generally convex surface to the interior chamber due to a preferably early and significant height drop in the crown surface as the surface extends from the front of the head to the rear.

In some embodiments at least a portion of the shroud overlies at least 50%, 60%, 70%, 80% or 90% of the crown's length (or depth) in the front to back direction (i.e., Y axis).

In some preferred embodiments, the golf club head preferably has a Delta 1 of about 8 to 28 mm, preferably about 11 to 25 mm, and more preferably about 14 to 22 mm. As one example, the head may have a Delta 1 of 16.1 mm. Delta 1 is a measure of how far rearward the head's CG is located in the "y" axis. The Delta 1 distance is measured along the "y" axis from a vertical plane passing through the hosel axis. Put another way, Delta 1 is the distance between the CG and hosel axis along the "y" axis (in a direction straight toward the back of the body of the club face from the geometric center of the striking face).

In some embodiments, the head preferably has a CG Projection of about −3 to 7 mm, more preferably about −1 to 5 mm, and most preferably about 0 to 4 mm. As one example, the head may have a CG Projection of 0.45 mm. CG Projection is a projection of the head's CG on to the head's striking surface that intersects with a line that is normal to the tangent line of the ball striking surface and passes through the CG. A positive number indicates that the CG Projection is above the geometric center of the face, and a negative number indicates that the CG Projection is below the geometric center of the face.

In some embodiments, the head has a CGz of about 2 to −10 mm, preferably about 0 to −8 mm, and most preferably about −2 to −6 mm. In one example, the head has a CGz of about −5.2 mm. CGz is the location of the head's CG on the "z" axis.

In some embodiments, the head has a Z-up of about 20 to 36 mm, preferably about 23 to 33 mm, and most preferably about 25 to 31 mm. In one example, the head may have a Z-up of about 24.7 mm. Z-up is a measure of the CG's distance from the ground plane (GP).

In some embodiments, the head may have Ixx and Izz of about 200 to 450 kg·mm$^2$ and 300 to 600 kg·mm$^2$ respectively; more preferably 230 to 390 kg·mm$^2$ and 330 to 530 kg·mm$^2$ respectively; and most preferably 260 to 320 kg·mm$^2$ and 360 to 490 kg·mm$^2$ respectively. In one example, the head may have respective Ixx and Izz of about 283 kg·mm$^2$ and 385 kg·mm$^2$. As described above, Ixx and Izz are measures of the club head's MOI relative to respective X and Z axes.

FIGS. 16 and 17 are respective top and front views of the club head of FIGS. 15A to 15E, with a portion of the crown removed. As shown in FIG. 16, the head has a drop contour area (CA) 96 on the crown which serves as a measurement indicator of favorable aerodynamic properties. The CA is described more fully in U.S. Pat. No. 8,858,359, the contents of which are incorporated herein in their entirety, including column 19, line 50 to column 20, line 8.

In summary, the CA is a relatively flat portion of the crown surrounding the apex of the crown (i.e., highest point of the crown in a certain orientation) and aids in keeping airflow attached to the club head (i.e., laminar flow) once it flows over the crown prior to and past the drop contour crown apex. The CA is determined by slicing the crown with a horizontal plane spaced 8 mm below the apex of the crown when the crown is pitched upward about a centerface tangent to a pitch angle of 12 degrees, as described more fully in U.S. Pat. No. 8,858,359. As so oriented, the peak height or apex of the crown is located, and a horizontal drop plane is located parallel to and 8 mm below the crown apex. An area CA (96 in FIG. 16) within an intersection of the plane and crown is measured. The CA 96 is a measurement of the "footprint" area of the portion of the crown removed by the horizontal plane intersecting the crown, as FIG. 16 illustrates. FIG. 16 also shows portions of the step-down crown (or drop crown).

FIG. 17 shows the horizontal "slice" taken from the crown, as viewed from the front and slightly above the club head when the slice is removed.

In some embodiments, the head has a CA of 1600 to 7800 mm$^2$, more preferably 3000 to 6000 mm$^2$, and most preferably 4000 to 5000 mm$^2$.

In one example, the CA may be 4724 mm$^2$, the CGZ is −5.2 mm, the Z-up is 24.7 mm, Ixx is 283 kg-mm2, and Izz 385 kg-mm2

It has been discovered that favorable CA properties in combination with a low strategically placed CG and one or more other features described herein provide a club head with very favorable aerodynamic and ball striking performance, including favorable forgiveness characteristics on mishits.

The components of the embodiments disclosed herein can be formed from any of various suitable metals, metal alloys, polymers, composites, or various combinations thereof.

In addition to those noted elsewhere herein, examples of metals and metal alloys that can be used to form the components include, without limitation, carbon steels (e.g., 1020 or 8620 carbon steel), stainless steels (e.g., 304 or 410 stainless steel), PH (precipitation-hardenable) alloys (e.g., 17-4, C450, or C455 alloys), titanium alloys (e.g., 3-2.5, 6-4, SP700, 15-3-3-3, 10-2-3, or other alpha/near alpha, alpha-beta, and beta/near beta titanium alloys), aluminum/aluminum alloys (e.g., 3000 series alloys, 5000 series alloys, 6000 series alloys, such as 6061-T6, and 7000 series alloys, such as 7075), magnesium alloys, copper alloys, nickel alloys, and tungsten.

Examples of composites that can be used to form the components include, without limitation, glass fiber reinforced polymers (GFRP), carbon fiber reinforced polymers (CFRP), metal matrix composites (MMC), ceramic matrix composites (CMC), and natural composites (e.g., wood composites).

Examples of polymers that can be used to form the components include, without limitation, thermoplastic materials (e.g., polyethylene, polypropylene, polystyrene, acrylic, PVC, ABS, polycarbonate, polyurethane, polyphenylene oxide (PPO), polyphenylene sulfide (PPS), polyether block amides, nylon, and engineered thermoplastics), thermosetting materials (e.g., polyurethane, epoxy, and polyester), copolymers, and elastomers (e.g., natural or synthetic rubber, EPDM, and Teflon®).

The designs, embodiments and features described herein may be combined with other club head features and technologies including:

1) movable weight features described in more detail in U.S. Pat. Nos. 6,773,360, 7,166,040, 7,452,285, 7,628,707, 7,186,190, 7,591,738, 7,963,861, 7,621,823, 7,448,963, 7,568,985, 7,578,753, 7,717,804, 7,717,805, 7,530,904, 7,540,811, 7,407,447, 7,632,194, 7,846,041, 7,419,441, 7,713,142, 7,744,484, 7,223,180, 7,410,425 and 7,410,426, the entire contents of each of which are incorporated by reference in their entirety herein;
2) slidable weight features described in more detail in U.S. Pat. Nos. 7,775,905 and 8,444,505, U.S. patent application Ser. No. 13/898,313 filed on May 20, 2013, U.S. patent application Ser. No. 14/047,880 filed on Oct. 7, 2013, the entire contents of each of which are hereby incorporated by reference herein in their entirety;
3) variable thickness face features described in more detail in U.S. patent application Ser. No. 12/006,060, U.S. Pat. Nos. 6,997,820, 6,800,038, and 6,824,475, which are incorporated herein by reference in their entirety;
4) composite face plate features described in more detail in U.S. patent application Ser. Nos. 11/998,435, 11/642,310, 11/825,138, 11/823,638, 12/004,386, 12/004,387, 11/960,609, 11/960,610 and U.S. Pat. No. 7,267,620, which are herein incorporated by reference in their entirety;
5) aerodynamic shape features described in more detail in U.S. Patent Publication No. 2013/0123040A1, the entire contents of which are incorporated by reference herein in their entirety;
6) removable shaft features described in more detail in U.S. Pat. No. 8,303,431, the contents of which are incorporated by reference herein in in their entirety;
7) adjustable loft/lie features described in more detail in U.S. Pat. No. 8,025,587, U.S. Pat. No. 8,235,831, U.S. Pat. No. 8,337,319, U.S. Patent Publication No. 2011/0312437A1, U.S. Patent Publication No. 2012/0258818A1, U.S. Patent Publication No. 2012/0122601A1, U.S. Patent Publication No. 2012/0071264A1, U.S. patent application Ser. No. 13/686,677, the entire contents of which are incorporated by reference herein in their entirety; and
8) adjustable sole features described in more detail in U.S. Pat. No. 8,337,319, U. S. Patent Publication Nos. US2011/0152000A1, US2011/0312437, US2012/

0122601A1, and U.S. patent application Ser. No. 13/686,677, the entire contents of each of which are incorporated by reference herein in their entirety.

In view of the many possible embodiments to which the principles of the disclosed invention may be applied, it should be recognized that the illustrated embodiments are only preferred examples of the invention and should not be taken as limiting the scope of the invention. Rather, the scope of the invention is defined by the following claims. We therefore claim as our invention all that comes within the scope and spirit of these claims.

We claim:

1. A golf club comprising:

a body defining a primary interior cavity enclosed by the body, the body including a strike plate positioned at a front of the body, a sole positioned at a bottom portion of the body, and a crown portion extending rearwardly from an upper portion of the strike plate and extending to an aft section at an opposite end of the body from the strike plate;

the crown portion having a stepped down portion which includes a front section proximate to the strike plate, a downwardly sloped towards the sole intermediate section and a less downwardly sloped rear section extending to the aft section and defining an obtuse angle with the intermediate section;

a shroud overlying the intermediate section and rear section of the crown portion and defining a secondary interior cavity with no exterior openings between the shroud and the crown portion, wherein the primary interior cavity is bounded by the strike plate, sole, intermediate section, rear section and aft section and extends rearwardly from the strike plate to the aft section, and the secondary interior cavity having an interior volume of about 20 to 50% of the primary interior cavity's interior volume.

2. The golf club of claim 1 wherein the shroud is made of a lighter material than the crown portion.

3. The golf club of claim 1 wherein the shroud is made of a composite material.

4. The golf club of claim 3 further including at least one rib secured at one end to a forward portion of the crown portion and at a different end to a rearward portion of the crown portion.

5. The golf club of claim 3 further including plural ribs, each secured at one end to a first surface of the crown portion and at opposite ends to a second surface of the crown portion, the first and second surfaces being angled relative to one another.

* * * * *